US006056042A

United States Patent [19]

Matsui et al.

[11] Patent Number: 6,056,042

[45] Date of Patent: May 2, 2000

[54] METHOD OF RESTORING USED MOLDING SAND

[75] Inventors: Kazuharu Matsui, Toyokawa; Takehiko Matsumoto, Shinshiro; Junichi Iwasaki; Eiji Yamaguchi, both of Toyokawa, all of Japan

[73] Assignee: Sintokogio, Ltd., Nagoya, Japan

[21] Appl. No.: 09/169,591

[22] Filed: Oct. 9, 1998

[30] Foreign Application Priority Data

Oct. 17, 1997 [JP] Japan ..... 9-303720

[51] Int. Cl.[7] ..... B22C 5/18

[52] U.S. Cl. ..... 164/456; 164/5

[58] Field of Search ..... 164/5, 456

[56] References Cited

U.S. PATENT DOCUMENTS 5,167,270 12/1992 Henych ..... 164/5

FOREIGN PATENT DOCUMENTS 2-21899 5/1990 Japan .

*Primary Examiner*—Kuang Y. Lin

*Attorney, Agent, or Firm*—Limbach & Limbach L.L.P.

[57] ABSTRACT

Measuring the degree of restoration during the restoring treatment of the used molding sand and comparing the measured degree of restoration to a permissible degree, comprising the following steps: First, the restored sand is photographed to project it as a picture on a monitor. A picture-processing device divides that picture into a certain number of picture parts and the brightness of each picture part is compared to the standard brightness, which is chosen beforehand. The degree of restoration is judged based on the number of picture parts that are lighter or darker than the standard brightness. The restoring treatment is stopped when the result of the comparison shows that the restoration has reached the permissible degree, but is continued when the result does not reach it. The operation of measuring the degree of restoration during the treatment is also repeated until it reaches the permissible degree. Then the treatment is stopped.

4 Claims, 2 Drawing Sheets

METHOD OF RESTORING USED MOLDING SAND

FIELD OF INVENTION

This invention is relevant to an improved method of a used-molding-sand-restoring treatment by a restoring device.

PRIOR ART

Hitherto, a used molding sand restoring treatment by a restoring device was carried out by, e.g., as with a batch-type restoring device, inserting a certain amount of molding sand into it and fixing the time for the treatment depending on the amount of the molding sand. As for the continuous-type restoring device, it was done by fixing the condition of the treatment such as by fixing the number of cycles of the restoring treatment. If the restoring degree were to be changed in regard to the purpose for using the molding sand, appropriate conditions for a proper treatment corresponding to the restoring degree would have to be found beforehand. The restoring treatments were carried out under such appropriate conditions to restore the molding sand to a permissible level. But, since the condition of used molding sand varies (by, e.g., the amount of water or clay contained), constantly attaining restored molding sand which has the permissible degree of restoration was difficult to achieve by the methods shown above. As a result, the condition and the quality of the restored sand varied corresponding to the condition and the quality of the used sand that was started with. When the molding was done by using such restored molding sand, various defects were found in the products, such as a lack of expected molding strength.

Due to this, a method to provide a restored sand having the stable degree of restoration, by judging the degree during the restoring treatment and determining the time of or the number of cycles of the treatment based on that judgment, was demanded. Therefore, the applicant has already invented a method of quickly judging the degree of restoration of the used sand and filed a patent application that was published as Japanese Patent Laid-open No. Hei-2-21899.

But the invention of that Japanese patent laid-open application is to judge the degree by measuring the spectral reflectance of a portion of the sand under treatment. Since the difference of the spectral reflection caused by the difference in the degree of restoration is slight, it has defects such as being difficult to adjust the measuring device corresponding to the spectral reflection.

This invention is conceived in view of the above prior-art drawbacks. It aims to provide a quick and accurate method of judging the restored molding sand to overcome the above problem.

SUMMARY OF THIS INVENTION

The method of this invention is to at first measure the degree to which the sand is restored during the restoring treatment of the used molding sand and to compare that measured degree to a permissible degree of restoration. This is done by photographing the used molding sand and sending a picture signal to a picture-processing device which is connected electrically to the photographing means. Then a picture is projected on a monitor based on the sent picture signal. This monitor is connected electrically to the picture-processing device. Then the picture-processing device divides the projected picture into a certain number of equal parts. Thereafter the processing device compares the brightness of each divided picture part to the standard brightness, which was chosen and recorded beforehand by the picture-processing device. Then the number of picture parts lighter or darker than the standard brightness within the divided picture are counted by the picture-processing device and the degree of restoration is judged by the number of picture parts with a lighter or darker shade.

Following the comparison, the restoring of the molding sand is controlled. This is done by stopping the restoring treatment when the result of the comparison shows that the permissible degree to which the sand has been restored has been reached or continuing it when the result shows that it has not been reached. When the treatment is continued, the operation of measuring the degree to which the sand has been restored during the treatment is repeated to the point where it reaches the permissible degree. Then the treatment is stopped.

DETAILED DESCRIPTION THE PREFERRED EMBODIMENT

Figure 1:
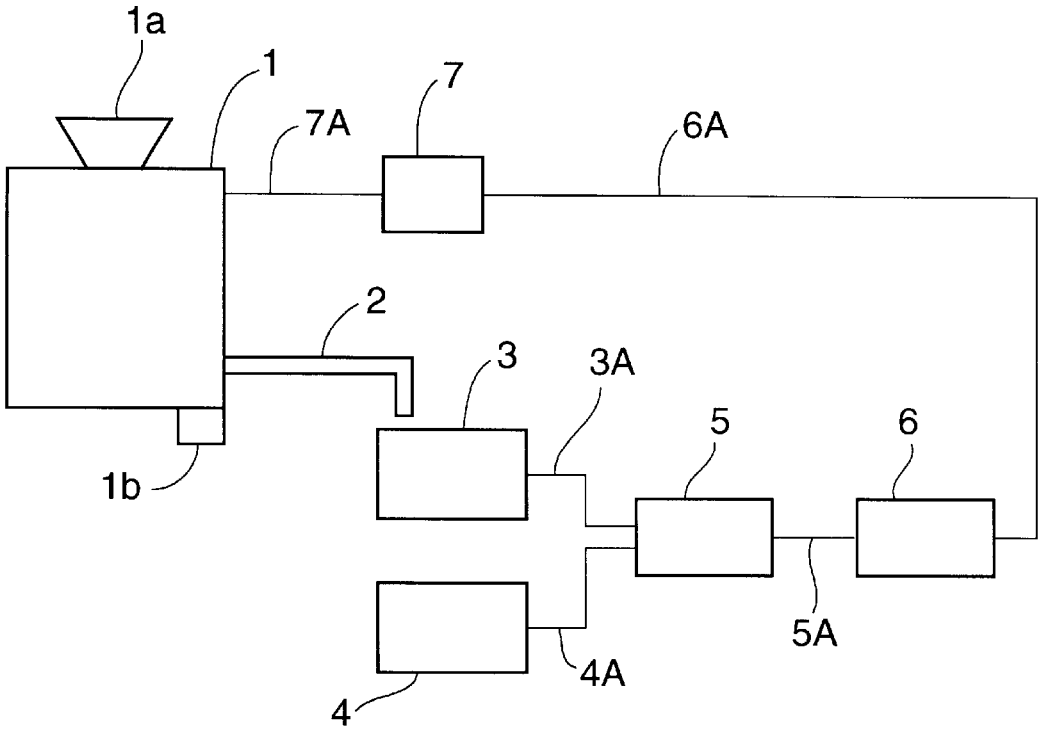
FIG. 1 is a diagrammatic view showing the first embodiment of this invention.

The preferred embodiments of this invention will now be explained by reference to the accompanying drawings. The following is the first embodiment of this invention. FIG. 1 shows a batch-type restoring device 1. It comprises an opening 1*a* to charge the used molding sand (hereafter "used sand S") on the top, a discharging opening 1*b* at the bottom, and a restoring treatment device inside to restore a certain amount of sand. Restoring the used sand S is started by inserting it through the hopper 1*a* into the restoring device 1. A proper amount of the used sand S is extracted from the restoring device 1 by a sampling device 2 provided at a lower part of the same device. The used sand S is taken out a certain time after treatment starts. The degree to which the used sand S that has been taken out by the sampling device 2 is then measured by a measuring means 3.

A comparing means 5 is connected electrically to the measuring means 3, which measures the degree to which the sand has been restored, and to a memory means 4, by cables 3A and 4A respectively. By this comparing means 5, the measured degree to which the used sand S has been restored is compared to the permissible degree recorded beforehand by the memory means 4. The result of the comparison by the comparison means 5 is sent to an output means 6, which is connected electrically to the comparison means 5 by a cable 5A. Depending on the result of the comparison by the comparison means 5, the output means 6 generates a signal to a restoring device controlling device 7, which is connected electrically to the generating means 6 by the cable 6A, to stop the restoring treatment. This is done when the result of the comparison shows that the degree to which the used sand S is restored has reached the permissible degree of restoration. If the result of the comparison shows that that degree has not reached the permissible degree, the output means 6 sends a signal to the controlling device 7 to continue the treatment. The restoring device 1 is connected electrically to the controlling device 7 by a cable 7A and it is controlled to stop or continue the treatment by the control device 7.

Figure 3:
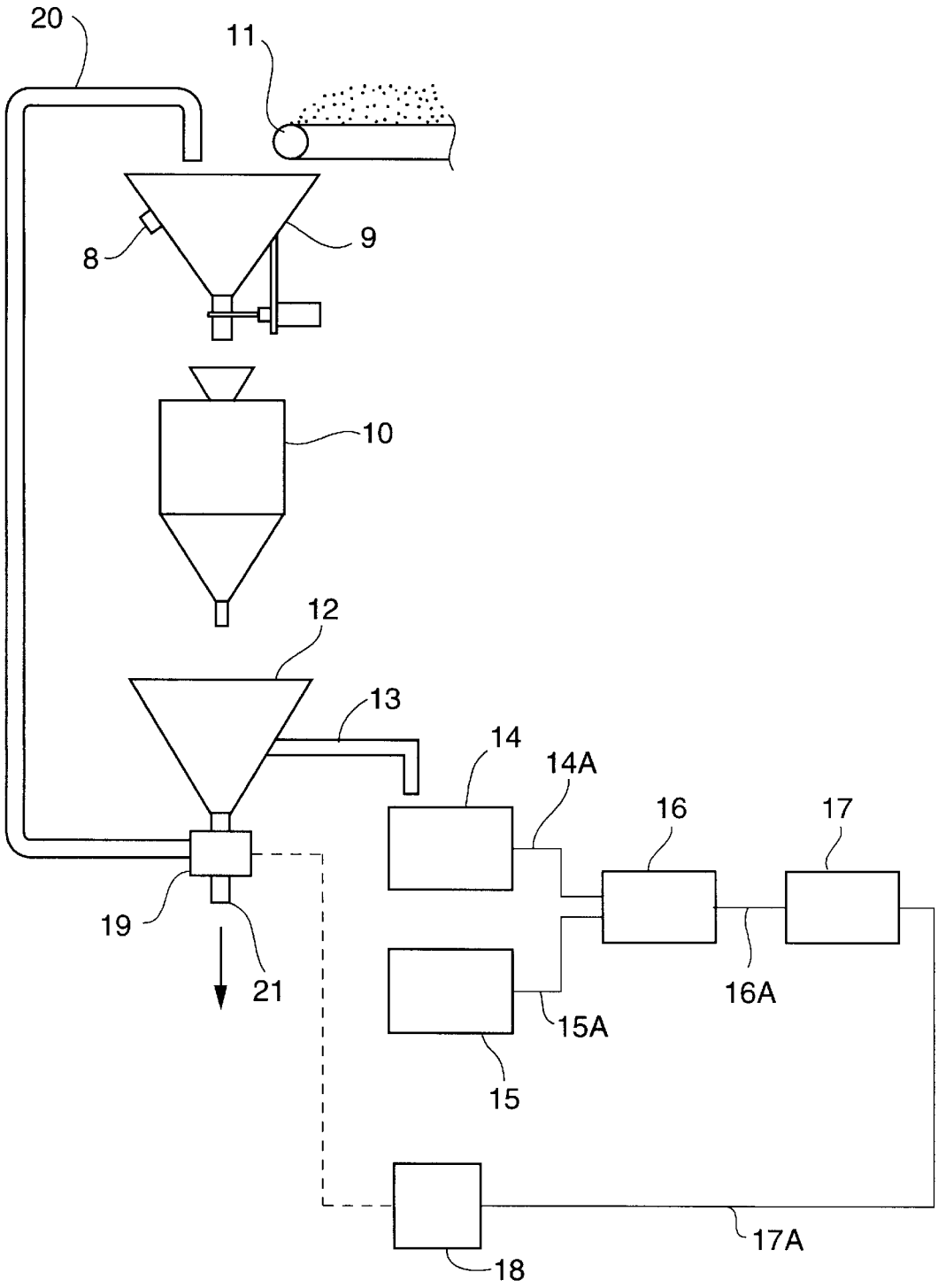
FIG. 3 is a diagrammatic view to show the second embodiment of this invention.

The following is the second embodiment of this invention. FIG. 3 shows a continuous-type restoring device 10. A certain amount of used sand S carried by a belt conveyor 11 is charged into the sand-supplying hopper 9, which is provided with a level meter 8 on its upper part. Further, the used sand S is continuously charged into the restoring device 10, which is positioned below the sand-supplying hopper 9. The used sand S is continuously discharged from the restoring device 10 to the lower hopper 12, which is provided below the restoring device 10 (the restoring treatment is also done by this restoring device 10). This discharge causes the used sand S to accumulate inside the lower hopper 12. A sampling device 13, which is provided at a side of the lower hopper 12, extracts a proper amount of this accumulated used sand S.

A measuring means 14 measures the degree to which the used sand S that has been extracted by the sampling device 13 has been restored. This degree is compared to the permissible degree of restoration within a memory means 15, wherein the permissible degree of restoration is recorded beforehand. This comparison is made by a comparing means 16, which is connected electrically to the measuring means 14 that measures the degree of restoration and to the memory means 15 by a cable 14A and a cable 15A respectively. The result of the comparison by the comparison means 16 is sent to an output means 17, which is connected electrically to the comparison means 16 by a cable 16A.

The output means 17 sends the result of the comparison by the comparison means 16 to a switch control device 18, which is connected electrically to the output means 17 by a cable 17A. If the result of the comparison shows that the degree that the used sand S has been restored has not reached the permissible degree, the switch control device 18 switches a switching valve 19 connected to the bottom opening of the lower hopper 12, whereby the used sand S is returned into the sand-supplying hopper 9 through a returning duct 20. Then the sand-receiving treatment is repeated. A returning duct 20 is provided to have the treated sand return to the sand hopper 9, which has one of its ends attached to the switching valve 19 and the other end attached to the opening of the sand-supplying hopper 9. The returning duct 20 can contain inside it a conveyor apparatus such as a screw conveyor, or an air duct.

If the result of the comparison shows that the degree to which the sand that has been restored and measured has reached the permissible degree, the restored sand is discharged by switching a switching valve 19 so as to communicate the lower hopper 12 with a discharging pipe 21, which is connected to the bottom of the switching valve 19.

Figure 2:
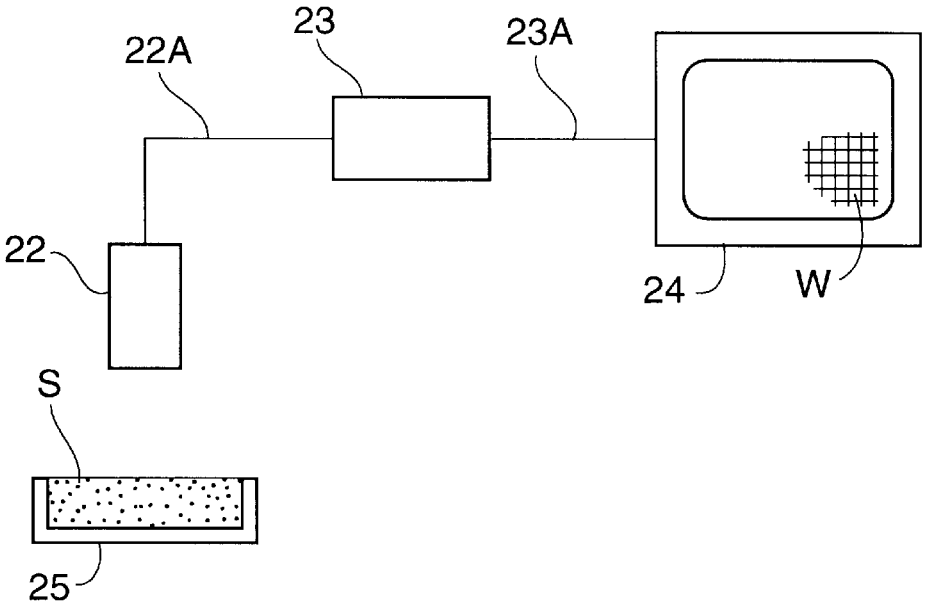
FIG. 2 is a diagrammatic view showing the outline of the apparatus to judge the degree to which the sand has been restored by this invention.

Further, these two embodiments may judge the degree to which the used sand S has been restored by using a device such as the one FIG. 2 shows as an example. FIG. 2 shows a photographing means, a camera 22, which photographs the top surface of the used sand S to produce a picture, a picture-processing means 23, which is connected to the camera 22 by a cable 22A, and a monitor 24, which is connected to the processing means 23 by a cable 23A.

The degree of restoration is detected by the following process: The proper amount of the used sand S is put into the flattened in a measurement container 25, which is disposed below the camera 22. Under the circumstances, the camera 22 photographs the top surface of the sued sand S inside a measurement container 25 and the picture signal of this is sent to the picture processing device 23. Then the picture signal is projected as a picture on a monitor 24, which is connected electrically to the picture-processing device 23 by a cable 23A. The picture projected on the monitor 24 is divided into a predetermined number of and equally scaled divided picture parts W. Specifically, the scale of each divided picture part W is equal to the 5 mm square of the top surface of used sand S divided into 74,000 equivalent portions, each of them becoming a single divided picture part. The size of each single divided picture part corresponds to each pixel. Further, by comparing each of the divided picture parts W to the recorded standard brightness T by the picture-processing device 23, the number of the divided picture parts W darker or lighter in shade than the standard brightness T is automatically counted by the picture-processing device 23.

The standard brightness T is chosen by the following process: A preparatory test is done beforehand to find the standard brightness T. Each portion of the used sand S which was treated based on the determined time by the batch-type restoring device 1 or treated once or a plurality of cycles by the continuous-type restoring device 10 is projected on the monitor 24. Depending on the process of modeling and the purpose for which the sand is to be used, the standard brightness that is the most proper one for the judgment of the restoration is chosen. The chosen standard brightness T is then recorded by the picture-processing device 23.

Detection of the degree of restoration is possible as above, due to the brightness (specifically, the luminance of the light and dark) of the picture. This is because the used sand S that is not restored has adhesive materials stuck around its grains, so its picture will be dark. As the restoring proceeds, the adhesive materials exfoliate from the sand grains, so the shade of the picture will be closer to the primary shade of grains, light. Therefore, the larger the number of light shaded sand grains, the more the used sand S is restored. As the scale of each divided picture part W is similar to each pixel, either the shade light or dark is likely to appear on the divided picture part W. Even if different shades appear on the divided picture part W, that divided picture part W will be judged whether its shade is lighter or darker than the standard brightness T from the entire brightness of its appearance. Therefore, the degree of restoration can be measured from counting the number of divided picture parts W that are lighter or darker in shade compared to the standard brightness T expressed in terms of a certain number of picture parts.

Thereafter the degree of restoration is measured based on the result of the number of the divided picture parts W that are counted. Within the divided picture part W, the larger the number of darker picture parts compared to the standard brightness T expressed by a certain number of picture parts, the lower the restoring degree is. The larger the number of lighter picture parts compared to the standard brightness T, the higher the restoring degree is.

From the foregoing explanations it will be understood that the present invention provides a method to stably attain restored sand that is restored to the permissible degree of restoration. This method also provides for the degree to which the used sand S is restored to be quickly, easily, and accurately judged.

What is claimed is:

1. A method of measuring the degree of luminance of restored molding sand that comprises the steps of:

photographing the restored molding sand by a photographing means and projecting a photograph on a monitor, dividing the projected photograph into a certain number of picture parts, comparing the brightness of each divided picture part to the standard brightness that was chosen and recorded beforehand, and counting the number of picture parts within the divided pictures that are lighter or darker than the standard brightness.

2. A method of performing restoration treatment on used molding sand comprising the steps of:

(a) photographing the used molding sand during the restoration treatment to obtain a picture signal, and sending the picture signal to a picture-processing device, (b) operating the picture-processing device to divide the projected picture into a certain number of picture parts, thus providing divided picture parts, and projecting a picture indicative of the divided picture parts on a monitor, (c) operating the picture-processing device to compare a brightness of each of the divided picture parts to a standard brightness, (d) operating the picture-processing device to count the number of picture parts within the divided picture parts that are lighter or darker in shade than the standard brightness, and judging the degree of restoration by the number of picture parts within the divided picture parts that are lighter or darker in shade than the standard brightness, (e) controlling the restoration of the molding sand by stopping the restoration treatment when the most recent performance of step (d) determines that a permissible degree of restoration has been reached, and continuing the treatment and repeating steps (a), (b), (c), and (d) when the most recent performance of step (d) determines that the permissible degree of restoration has not been reached.

3. A method of restoring used molding sand comprising the steps of:

charging a certain amount of used molding sand into a batch-type restoring device at one time, extracting a certain amount of the sand inside the batch-type device with a sampling device to measure its degree of restoration during the restoring treatment, comparing, to a permissible degree of restoration, the degree to which the used sand extracted by the sampling device has been restored, sending a signal to the restoring device to cause the restoring treatment to continue or stop, depending on the result of the comparison, wherein the step of comparing includes the steps of:

photographing the restored molding sand by a photographing means to obtain a picture signal, sending the picture signal to a picture-processing device, which is connected electrically to the photographing means by a cable, projecting a picture on a monitor based on said sent picture signal, with the picture-processing device causing the projected picture to be divided into a certain number of picture parts, comparing, by the picture-processing device, the brightness of each of the picture parts to a standard brightness which was chosen and recorded beforehand by the picture-processing device, generating a count, using the picture-processing device of those of the picture parts that are lighter or darker than the standard brightness, and judging the degree to which the picture is lighter or darker brightness than the standard brightness using said count.

4. A method of restoring used molding sand comprising the steps of:

charging a certain amount of used molding sand carried by a sand-carrying means into a sand-supplying hopper, supplying used molding sand continuously from the sand-supplying hopper into a continuous-type restoring device that is provided below the sand-supplying hopper, operating a continuous-type restoring device to carry out a restoring treatment on the used molding sand that ha been continuously supplied into the continuous-type restoring device from the sand-supplying hopper while continuously discharging the used sand to cause the discharged used sand to accumulate in a lower hopper which is below the continuous-type restoring device, extracting a certain amount of the discharged used sand using a sampling device provided at the lower hopper, comparing, to a permissible degree of restoration, the degree to which the used sand extracted by the sampling device has been restored, sending the result of the comparison to a restoring control device, returning the used molding sand in the lower hopper to the sand-supplying hopper through a returning duct which has one end attached to a switching valve and another end to the sand-supplying hopper and repeating the restoring treatment when the result of the comparison shows that the sand has not reached the permissible restoring degree, and discharging the used molding sand by switching the switching valve so as to connect the lower hopper to a discharging pipe, which is connected to the switching valve, when the sand has been restored to the permissible degree of restoration, wherein the step of comparing include the steps of:

photographing the restored molding sand by a photographing means to obtain a picture signal, sending the picture signal to a picture-processing device, which is connected electrically to the photographing means by a cable, projecting a picture on a monitor based on said sent picture signal, with the picture-processing device causing the projected picture to be divided into a certain number of picture parts, operating the picture-processing device to compare the brightness of each of the picture parts to a standard brightness which has been recorded beforehand by the picture-processing device, generating a count, using the picture-processing device, of those of the picture parts that are lighter or darker than the standard brightness, and judging the degree to which the picture is of lighter or darker brightness than the standard brightness using said count.

* * * * *